US008550248B1

(12) United States Patent
Busen

(10) Patent No.: US 8,550,248 B1
(45) Date of Patent: Oct. 8, 2013

(54) PERSONALIZABLE ORGANIZER DISPLAY FOR IDENTIFYING ACTUAL PILL SAMPLES AND INDICATING ASSOCIATED INFORMATION THEREWITH

(76) Inventor: Natalie M. Busen, Nashville, TN (US)

( * ) Notice: Subject to any disclaimer, the term of this patent is extended or adjusted under 35 U.S.C. 154(b) by 223 days.

(21) Appl. No.: 13/135,631

(22) Filed: Jul. 11, 2011

(51) Int. Cl.
*B65D 83/04* (2006.01)

(52) U.S. Cl.
USPC ..... 206/534; 206/538

(58) Field of Classification Search
USPC ..... 206/232, 570, 571, 528–539; 211/10, 211/72, 87.01
See application file for complete search history.

(56) References Cited

U.S. PATENT DOCUMENTS

| | | | | |
|---|---|---|---|---|
| 4,782,952 | A * | 11/1988 | Allen | 206/534 |
| 4,811,845 | A * | 3/1989 | Baggett | 206/534 |
| 4,890,741 | A * | 1/1990 | Edelstein | 206/534 |
| 4,936,462 | A * | 6/1990 | Yuen | 206/232 |
| 5,046,609 | A * | 9/1991 | Mangini et al. | 206/232 |
| D337,046 | S | 7/1993 | Fuller et al. | |
| 5,372,258 | A | 12/1994 | Daneshvar | |
| 6,422,875 | B1 * | 7/2002 | Patak et al. | 434/408 |
| 6,575,297 | B2 * | 6/2003 | Schutten | 206/232 |
| 7,188,738 | B2 * | 3/2007 | Stafford et al. | 211/72 |
| 7,200,071 | B2 | 4/2007 | Brophy | |
| D547,052 | S | 7/2007 | Cooper | |
| 7,240,793 | B2 | 7/2007 | McBain | |
| 7,661,530 | B1 | 2/2010 | Hewitt | |
| 2004/0251165 | A1 * | 12/2004 | Girzaitis | 206/534 |
| 2005/0029156 | A1 | 2/2005 | Girzaitis | |
| 2005/0045519 | A1 | 3/2005 | Hirsch | |
| 2005/0218152 | A1 | 10/2005 | Simon | |

* cited by examiner

*Primary Examiner* — Luan K Bui
(74) *Attorney, Agent, or Firm* — Richard L. Miller

(57) ABSTRACT

A personalizable display for identifying actual pill samples and indicating associated information so as to visually correlate the actual pill samples with the associated information. The display includes a substrate, a plurality of containers, and a plurality of pockets. The plurality of containers are disposed in the substrate, and visually hold the actual pill samples. The plurality of pockets are disposed on the substrate, visually hold the associated information, and are disposed adjacent to associated ones of the plurality of containers so as to visually correlate the actual pill samples with the associated information, and among other things, identify the actual pill samples.

32 Claims, 10 Drawing Sheets

PERSONALIZABLE ORGANIZER DISPLAY FOR IDENTIFYING ACTUAL PILL SAMPLES AND INDICATING ASSOCIATED INFORMATION THEREWITH

1. BACKGROUND OF THE INVENTION

A. Field of the Invention

The embodiments of the present invention relate to a medication illustrator, and more particularly, the embodiments of the present invention relate to a personalizable display for identifying actual pill samples and indicating associated information so as to visually correlate the actual pill samples with the associated information.

B. Description of the Prior Art

When a person is ill, that person can take a lot of different medications on a daily basis. Some medications can be taken once a day, while other medications can be taken two or three times a day. When the doctor takes a patient off a certain medication, there is no way to know which pill to take out of the weekly organizing dispenser without going through every bottle. To make matters worse, the pharmacy frequently changes drug manufacturers so that the pill in the bottle might not match the pill in the weekly organizing dispenser.

Thus, there exists a need for a personalizable display for identifying actual pill samples and indicating associated information so as to visually correlate the actual pill samples with the associated information.

Numerous innovations for medication organizers have been provided in the prior art, which will be described below in chronological order to show advancement in the art, and which are incorporated herein by reference thereto. Even though these innovations may be suitable for the specific individual purposes to which they address, nevertheless, they differ from the present invention in that they do not teach a personalizable display for identifying actual pill samples and indicating associated information so as to visually correlate the actual pill samples with the associated information.

(1) U.S. Pat. No. Des. 337,046 to Fuller et al.

U.S. Pat. No. Des. 337,046—issued to Fuller et al. on Jul. 6, 1993 in U.S. class D9 and subclass 732—teaches te ornamental design for a pill organizer calendar.

(2) U.S. Pat. No. 5,372,258 to Daneshvar.

U.S. Pat. No. 5,372,258—issued to Daneshvar on Dec. 13, 1994 in U.S. class 206 and subclass 534—a pill sample illustrator having two rectangular and transparent plastic sheets that come together to enclose pill samples, and a medical chart. These sheets provide a single row of individual pill sample receiving spaces for the pill samples along one side of the illustrator and a larger adjacent space for the medical chart. The medical chart contains bands extending from the pill sample receiving spaces to the opposite side of the illustrator. Each band contains indicia for relating to a pill sample in a corresponding one of the pill receiving spaces. The pill sample illustrator also forms a lid for a box that contains supplies of the pills that are to be taken by a patient.

(3) United States Patent Application Publication Number 2005/0029156 to Girzaitis.

United States Patent Application Publication Number 2005/0029156—published to Girzaitis on Feb. 10, 2005 in U.S. class 206 and subclass 570—teaches a medication organizer system including an arrangement of day of the week containers, with each container divided into separate time of the day compartments. Each time of the day compartment has pictorial indicia that readily signifies a specific respective time of the day. A medication organized worksheet is provided with medication/pill identifying pictorial indicia and an imprinted grid that tracts the container and compartment arrangement. The grid has juxtaposed imprinted pictorial indicia corresponding to the compartment pictorial indicia. A sheet of adhesive backed peel-off numerals is provided, whereby a peeled-off numeral is adhered to the medication organizer worksheet juxtaposed to the grid and another peeled-off same numeral is adhered to the container for the specific medication. A medication organizer instruction sheet containing pictorials is provided to permit a layperson to readily use the medication organizer system.

(4) United States Patent Application Publication Number 2005/0045519 to Hirsch.

United States Patent Application Publication Number 2005/0045519—published to Hirsch on Mar. 3, 2005 in U.S. class 206 and subclass 534—teaches an organizer and divider for medications, which is contained within a single unit and configured for the convenience and safety of users who may have mental and physical handicaps in handling their health needs.

(5) United States Patent Application Publication Number 2005/0218152 to Simon.

United States Patent Application Publication Number 2005/0218152—published to Simon on Oct. 6, 2005 in U.S. class 221 and subclass 203—teaches a customizable container that is used with a method of filling, storing, and dispensing medication. The method employs a medication database, and analyzes medication storage requirements to determine a customized container size and configuration for an individual pill-user. Container preparation instructions are generated to computer-tailor the customized container based upon the determined needs of the individual pill-user. A pharmacist uses the container preparation instructions to organize medications in the proper dosage administration sequence in separate reconfigurable compartments of the pill pack container. The pill pack container is individually customized for each individual pill taker to organize, store, and dispense correctly a supply of pills of multiple types, sizes, and shapes for a predetermined time period.

(6) U.S. Pat. No. 7,200,071 to Brophy.

U.S. Pat. No. 7,200,071—issued to Brophy on Apr. 3, 2007 in U.S. class 368 and subclass 28—teaches a personal organization tool including an indicator and an analog display divided into areas representing days of the week to help people organize themselves and remind them of various events or activities. The tool may be used in cooperation with an apparatus for providing information. The tool is particularly useful for people with short-term memory loss who often experience difficulty in keeping track of when they are supposed to do something.

(7) U.S. Pat. No. 7,240,793 to McBain.

U.S. Pat. No. 7,240,793—issued to McBain on Jul. 10, 2007 in U.S. class 206 and subclass 534—teaches a multiple medication management system and method that enables patients and caregivers to accurately track medications on a compact chart. The system and method use a plurality of containers for storage of current medications, medications needing refills, and medications discontinued by a physician. Thus, patients and caregivers are able to efficiently and accurately track medications, including which medications need refilling. Furthermore, discontinued medications can be safely retained in case they are later prescribed again by a patient's physician.

(8) U.S. Pat. No. Des. 547,052 to Cooper.

U.S. Pat. No. Des. 547,052—issued to Cooper on Jul. 24, 2007 in U.S. class D3 and subclass 203.3—teaches the ornamental design for a pill organizer.

(9) U.S. Pat. No. 7,661,530 to Hewitt.

U.S. Pat. No. 7,661,530—issued to Hewitt on Feb. 16, 2010 in U.S. class 206 and subclass 528—teaches a pill organizer assembly and an associated method of organizing and isolating multiple doses of pharmaceuticals using a pill organizer. The pill organizer includes a holding case. A plurality of partition walls extend between the side walls in the holding case. The partition walls define a plurality of compartments. A lid is provided that is selectively positionable into a closed position on the holding case. A plurality of removable receptacles are provided. A removable receptacle is disposed within each of the plurality of compartments. The lid creates a seal against each of the removable receptacles when the removable receptacles are within the plurality of compartments and the lid is in its closed position. The seal created by the lid isolates the contents of the removable receptacles until they are removed from the holding case.

It is apparent that numerous innovations for medication organizers have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a personalizable display for identifying actual pill samples and indicating associated information so as to visually correlate the actual pill samples with the associated information.

2. SUMMARY OF THE INVENTION

Thus, an object of the embodiments of the present invention is to provide a personalizable display for identifying actual pill samples and indicating associated information so as to visually correlate the actual pill samples with the associated information, which avoids the disadvantages of the prior art.

Briefly stated, another object of the embodiments of the present invention is to provide a personalizable display for identifying actual pill samples and indicating associated information so as to visually correlate the actual pill samples with the associated information. The display includes a substrate, a plurality of containers, and a plurality of pockets. The plurality of containers are disposed in the substrate, and visually hold the actual pill samples. The plurality of pockets are disposed on the substrate, visually hold the associated information, and are disposed adjacent to associated ones of the plurality of containers so as to visually correlate the actual pill samples with the associated information, and among other things, identify the actual pill samples.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

Figure 2:
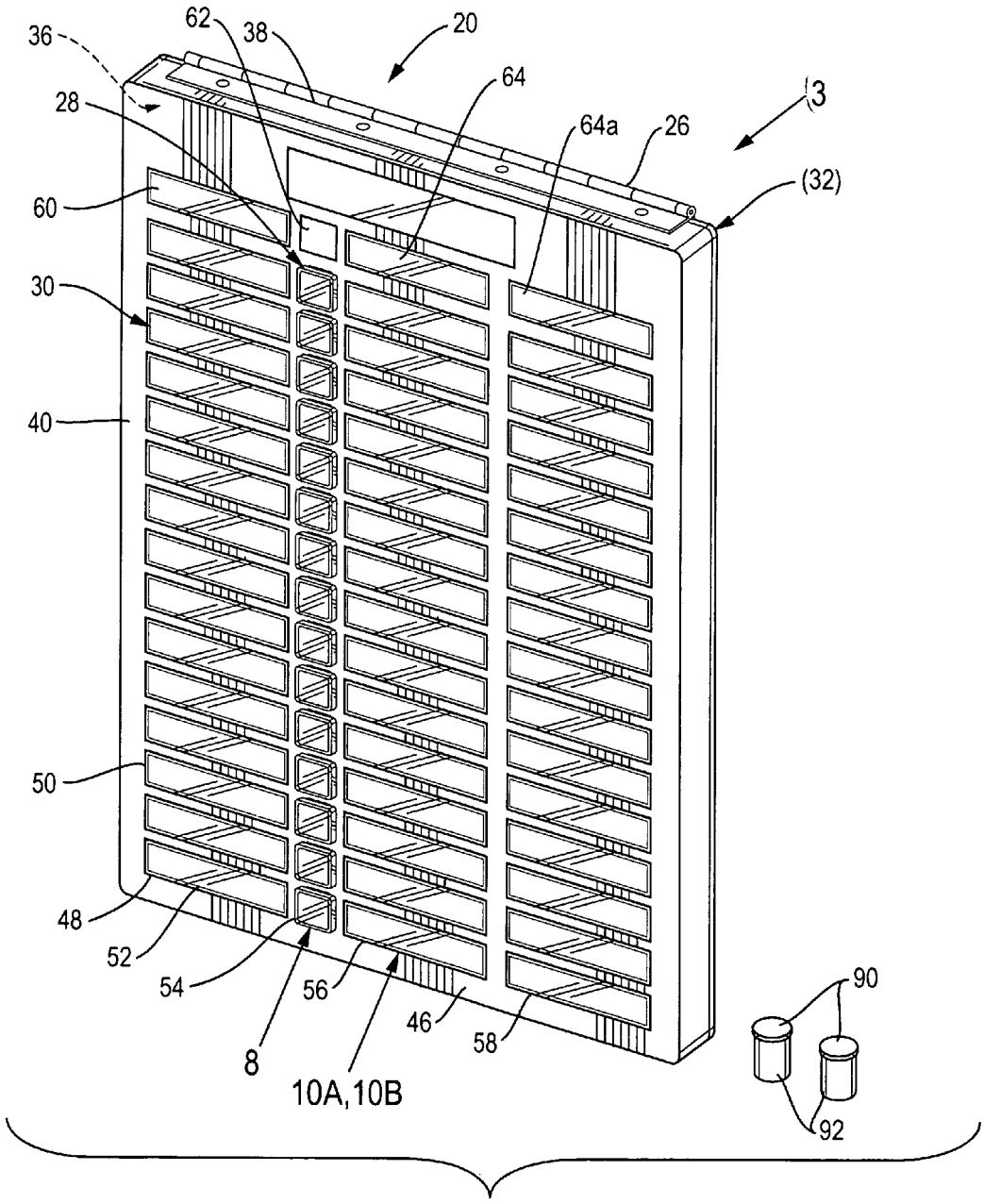
FIG. 2 is a reduced diagrammatic perspective view of the personalizable display of the embodiments of the present invention identified by ARROW 2 in FIG. 1.
Figure 10A:
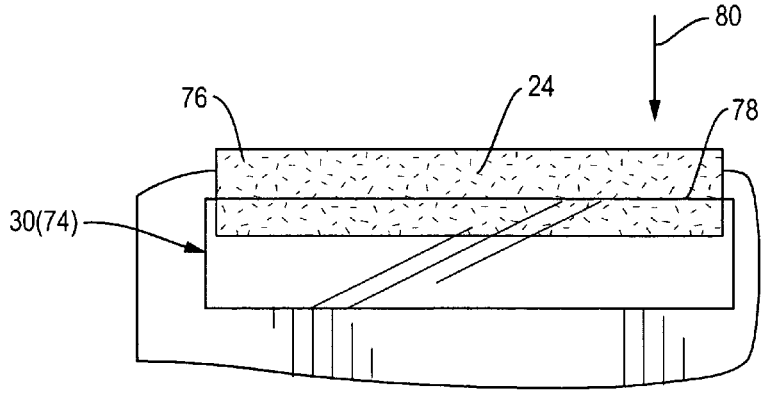
Figure 10B:
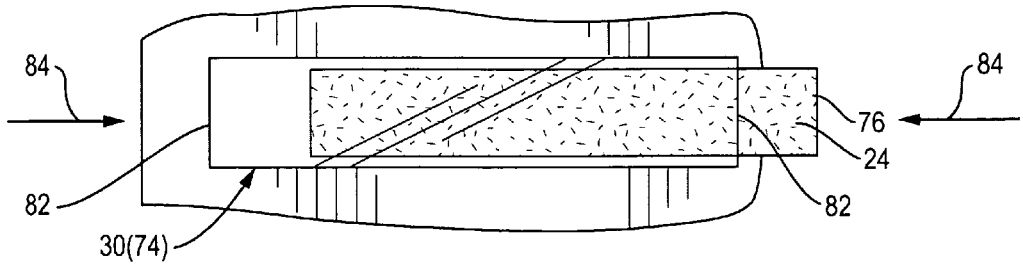
Figure 11:
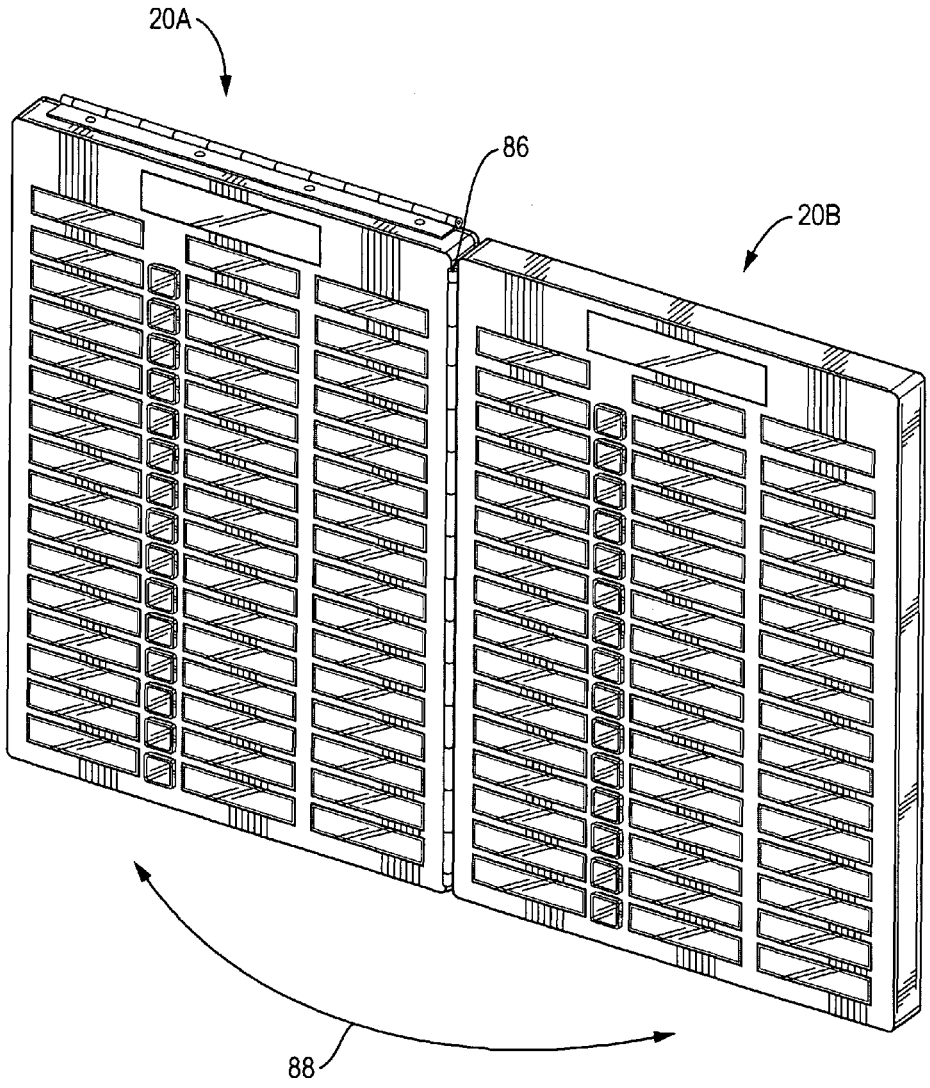

FIG. 10A an enlarged diagrammatic front elevational view of typical top loading pocket of the personalizable display of the embodiments of the present invention identified by ARROW 10A in FIG. 2;

FIG. 10B is an enlarged diagrammatic front elevational view of typical side loading pocket of the personalizable display of the embodiments of the present invention identified by ARROW 10B in FIG. 2; and FIG. 11 is a diagrammatic perspective view of the personalizable display of the embodiments of the present invention including a pair of side-by-side boxes detachably attached to each other for ready expansion to double Capacity and pivotally hinged to each other so as to store like a book.

4. LIST OF REFERENCE NUMERALS UTILIZED IN THE FIGURES OF THE DRAWING

A. General.

20 personalizable display of embodiments of present invention for identifying actual pill samples 22 and indicating associated information 24 so as to visually correlate actual pill samples 22 with associated information 24

22 actual pill samples

24 associated information

B. Overall Configuration of Personalizable Display 20.

26 substrate

28 plurality of containers for visually holding actual pill samples 22

30 plurality of pockets for visually holding associated information 24

(1) Substrate 26.

32 box of substrate 26

34 front wall of box 32 of substrate 26

36 storage compartment in box 32 of substrate 26

38 hinge of box of substrate 26

40 rear wall of box 32 of substrate 26

42 clip of front wall 34 of box 32 of substrate 26
44 clipboard of front wall 34 of box 32 of substrate 26
(2) Plurality of Containers 28 and Plurality of Pockets 30.
46 matrix of plurality of containers 28 and plurality of pockets 30
48 columns of matrix 46 of plurality of containers 28 and plurality of pockets 30
50 rows of matrix 46 of plurality of containers 28 and plurality of pockets 30
52 first column of columns 48 of matrix 46 of plurality of containers 28 and plurality of pockets 30
54 second column of columns 48 of matrix 46 of plurality of containers 28 and plurality of pockets 30
56 third column of columns 48 of matrix 46 of plurality of containers 28 and plurality of pockets 30
58 fourth column of columns 48 of matrix 46 of plurality of containers 28 and plurality of pockets 30
60 first header pocket of plurality of pockets 30 of first column 52 of columns 48 of matrix 46 of plurality of containers 28 and plurality of pockets 30
61 "Drug Name" of associated information 24
61*b* "Pill" of associated information 24
62 second header pocket of plurality of pockets 30 of second column 54 of columns 48 of matrix 46
63 "Dosage" of associated information 24
64 third header pocket of plurality of pockets 30 of third column 56 of columns 48 of matrix 46
64*a* fourth header pocket of plurality of pockets 30 of fourth column 58 of columns 48 of matrix 46
65 "Reason Taken" of associated information 24
65*a* "Once Daily (AM)" of associated information 24 of first group of first column 52 of columns 48 of matrix 46
65*b* first color of slips 76
65*c* "Twice Daily (AM & PM)" of associated information 24 of second group of first column 52 of columns 48 of matrix 46
65*d* second color of slips 76
65*e* "Three Times Daily" of associated information 24 of third group of first column 52 of columns 48 of matrix 46
65*f* third color of slips 76
65*g* "Nightly" of associated information 24 of fourth group of first column 52 of columns 48 of matrix 46
65*h* fourth color of slips 76
65*i* "As Needed" of associated information 24 of fifth group of first column 52 of columns 48 of matrix 46
65*j* fifth color of slips 76
C. Specific Configuration of Plurality of Containers 28.
66 box of each container of plurality of containers 28
67 void in rear wall 40 of box 32 of substrate 26
68 open top of box 66 of each container of plurality of containers 28
70 lid of box 66 of each container of plurality of containers 28
72 living hinge of box 66 of each container of plurality of containers 28
D. Specific Configuration of Plurality of Pockets 30.
74 transparent and generally rectangular-shaped pocket of each pocket of plurality of pockets 30
76 slips having associated information 24 thereon
78 open top of transparent and generally rectangular-shaped pocket 74 of each pocket of plurality of pockets 30
80 slip insertion arrow of slip 76 having associated information 24 thereon
82 open sides of transparent and generally rectangular-shaped pocket 74 of each pocket of plurality of pockets 30
84 slip insertion arrows of slip 76 having associated information 24 thereon
E. Specific Configuration of Multiple Personalizable Displays 20.
20A first personalizable display
20B second personalizable display
86 hinge
88 arrow
F. Stickers 90.
90 stickers for sticking to pill bottles 92
92 pill bottle caps

5. DETAILED DESCRIPTION OF THE PREFERRED EMBODIMENTS

A. General.

Figure 1:
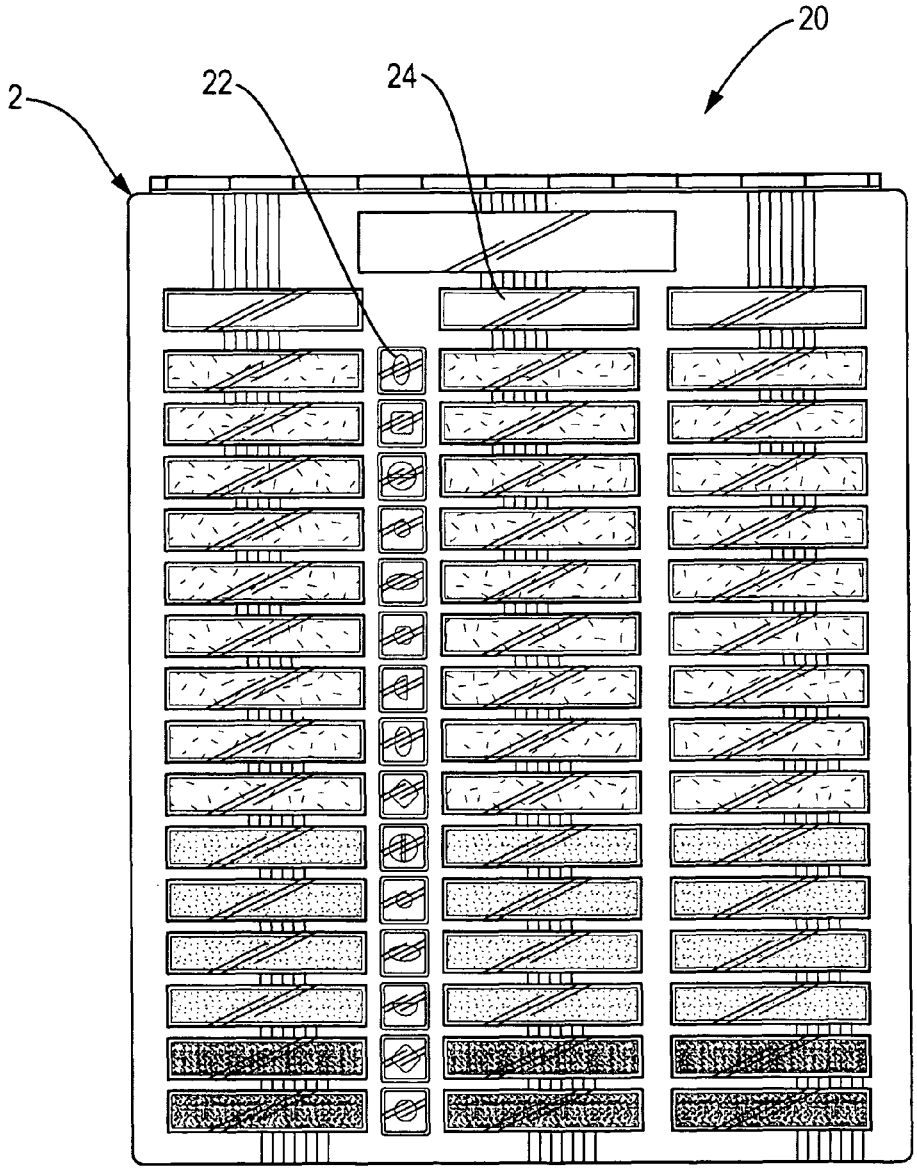
FIG. 1 is a diagrammatic elevational front view of the personalizable display of the embodiments of the present invention identifying actual pill samples and indicating associated information so as to visually correlate the actual pill samples with the associated information.

Referring now to the figures, in which like numerals indicate like parts, and particularly to FIG. 1, which is a diagrammatic elevational front view of the personalizable display of the embodiments of the present invention identifying actual pill samples and indicating associated information so as to visually correlate the actual pill samples with the associated information, the personalizable display of the embodiments of the present invention is shown generally at 20 for identifying actual pill samples 22 and indicating associated information 24 so as to visually correlate the actual pill samples 22 with the associated information 24.

B. Overall Configuration of the Personalizable Display 20.

Figure 3:
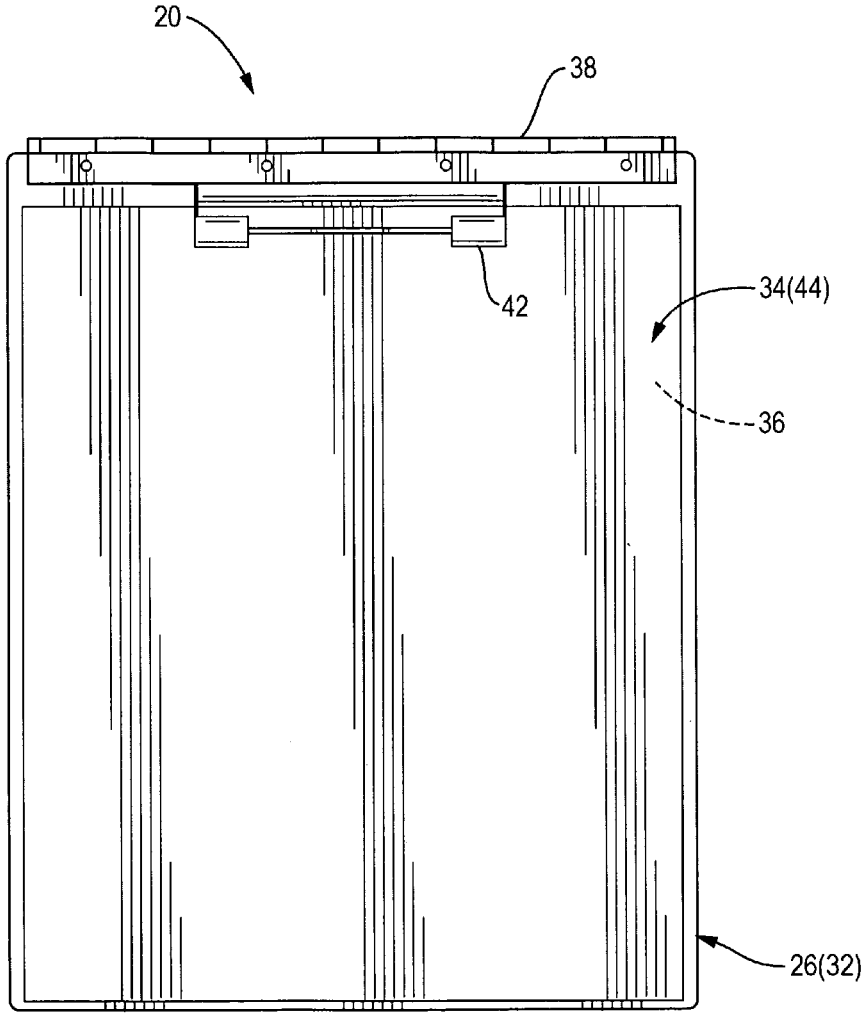
FIG. 3 is an enlarged diagrammatic rear elevational view taken generally in the direction of ARROW 3 in FIG. 2 of the personalizable display of the embodiments of the present invention.
Figure 4:
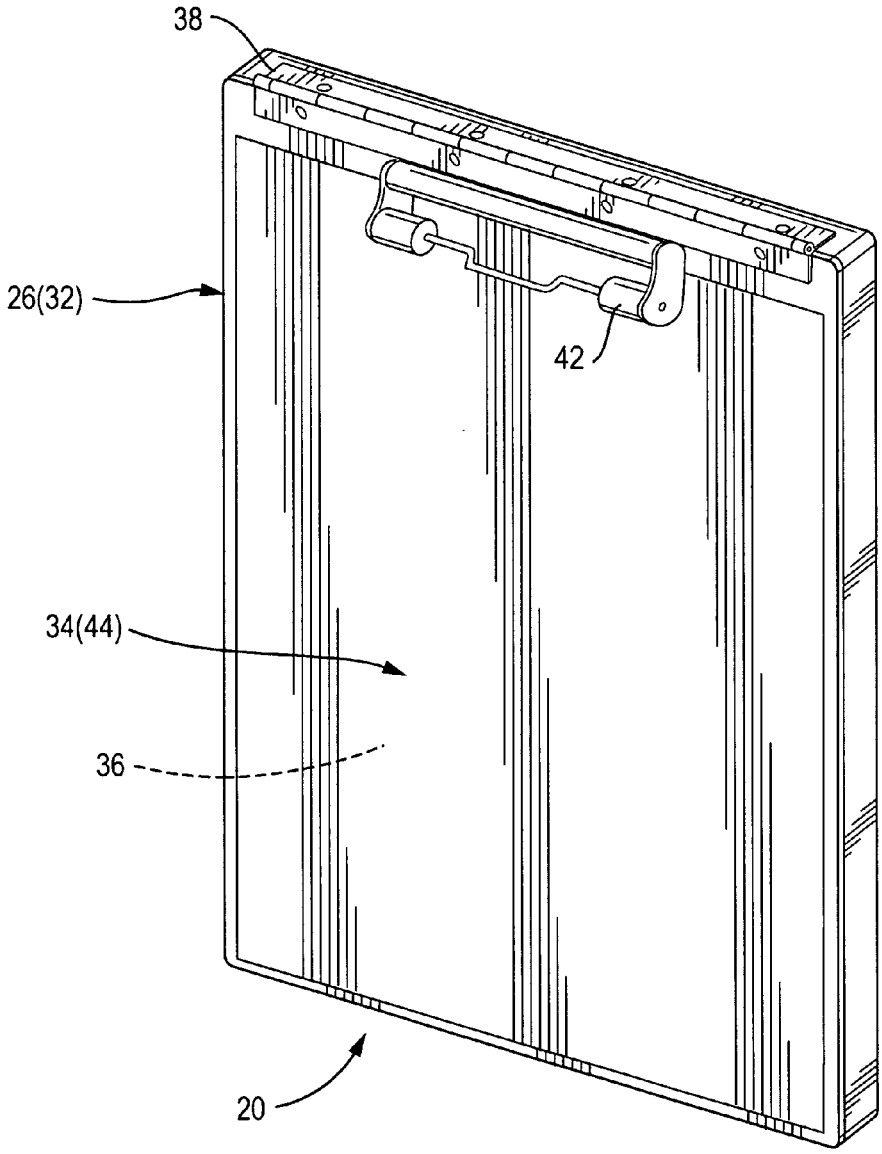
FIG. 4 is a diagrammatic perspective view of the personalizable display of the embodiments of the present invention shown in FIG. 3 with the cover closed.
Figure 5:
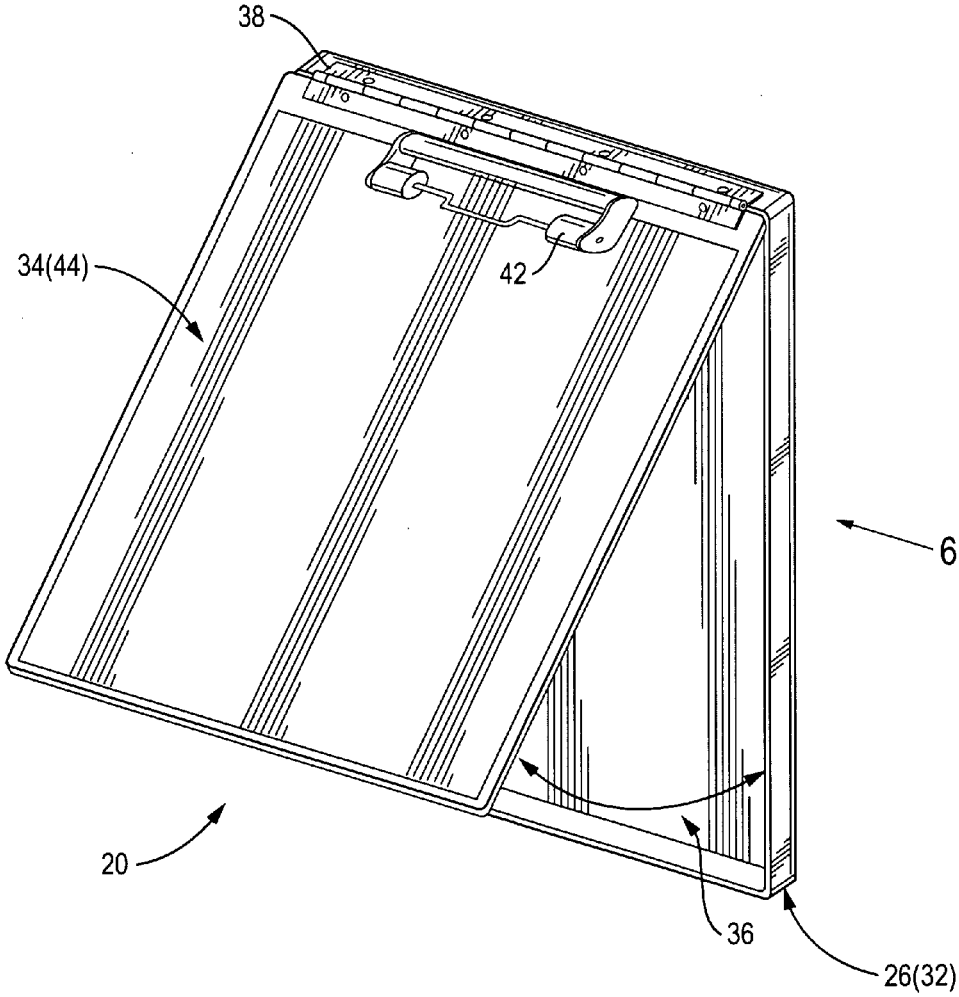
FIG. 5 is a diagrammatic perspective view of the personalizable display of the embodiments of the present invention shown in FIG. 4 with the cover opening.
Figure 6:
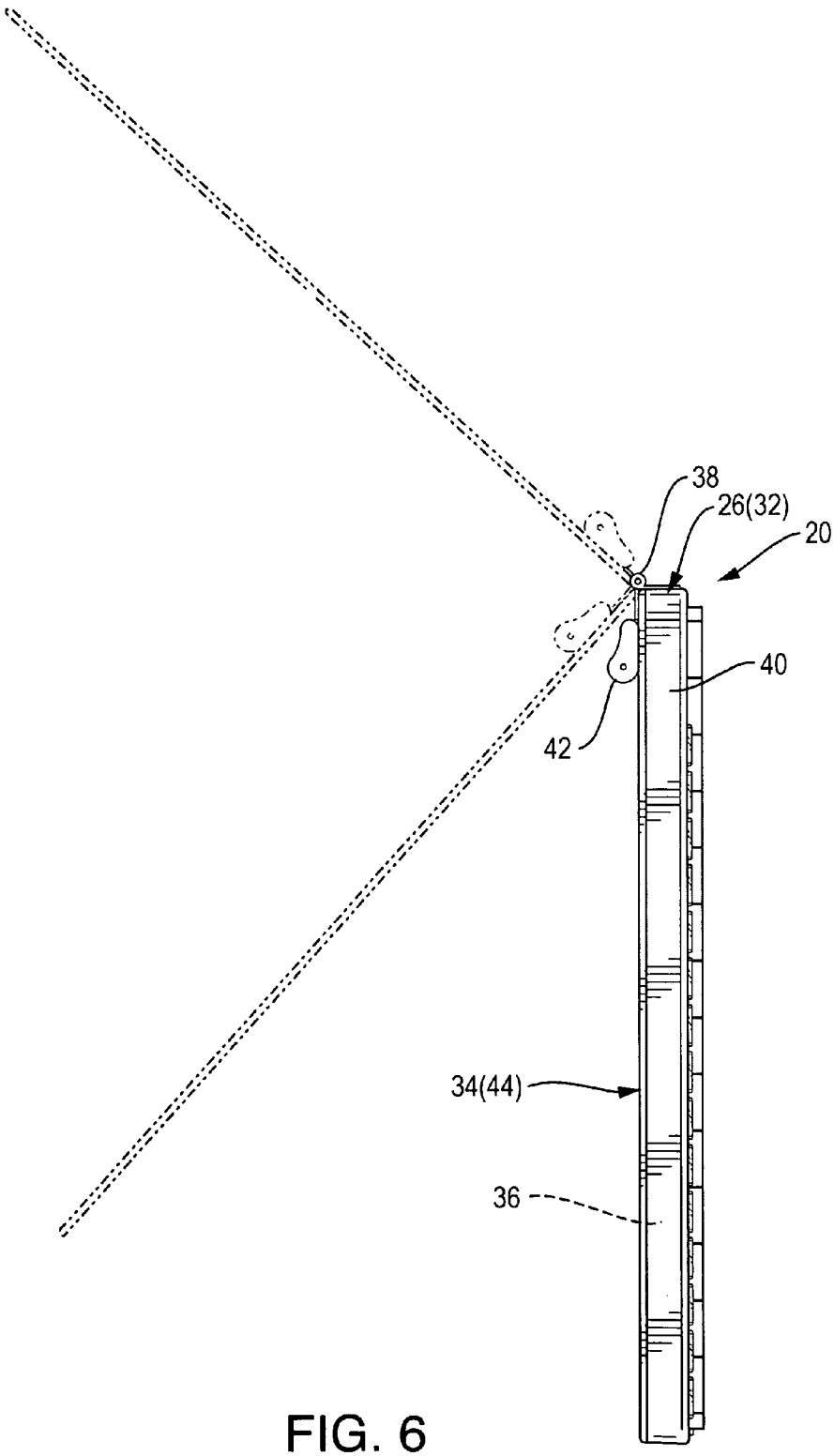
FIG. 6 is an enlarged diagrammatic side elevational view taken generally in the direction of ARROW 6 in FIG. 5.

The overall configuration of the personalizable display 20 can best be seen in FIGS. 2-7, which are, respectively, a reduced diagrammatic perspective view of the personalizable display of the embodiments of the present invention identified by ARROW 2 in FIG. 1, an enlarged diagrammatic rear elevational view taken generally in the direction of ARROW 3 in FIG. 2 of the personalizable display of the embodiments of the present invention, a diagrammatic perspective view of the personalizable display of the embodiments of the present invention shown in FIG. 3 with the cover closed, a diagrammatic perspective view of the personalizable display of the embodiments of the present invention shown in FIG. 4 with the cover opening, an enlarged diagrammatic side elevational view taken generally in the direction of ARROW 6 in FIG. 5, and a diagrammatic front elevational view of an example of the plurality of containers with the actual sample pills therein and the plurality of pockets with the associated information thereunder of the personalizable display of the embodiments of the present invention shown in FIGS. 1 and 2, and as such, will be discussed with reference thereto.

The personalizable display 20 comprises a substrate 26, a plurality of containers 28, and a plurality of pockets 30.

The plurality of containers 28 are disposed in the substrate 26, and are for visually holding the actual pill samples 22.

The plurality of pockets 30 are disposed on the substrate 26, and are for visually holding the associated information 24.

The plurality of pockets 30 are disposed adjacent to associated ones of the plurality of containers 28 so as to visually correlate the actual pill samples 22 with the associated information 24, and among other things, identify the actual pill samples 22.

(1) Substrate 26.

The substrate 26 is a box 32. The box 32 of the substrate 26 has a front wall 34, and contains a storage compartment 36. The front wall 34 of the box 32 of the substrate 26 is hingedly attached to the box 32 of the substrate 26 by a hinge 38 so as to allow access to the storage compartment 36 in the box 32 of the substrate 26.

The box 32 of the substrate 26 further has a rear wall 40. The rear wall 40 of the box 32 of the substrate 26 opposes the front wall 34 of the box 32 of the substrate 26.

The rear wall 40 of the box 32 of the substrate 26 has the plurality of containers 28 and the plurality of pockets 30 operating therein/thereon, respectively.

The front wall 34 of the box 32 of the substrate 26 has a clip 42 thereon so as to allow the front wall 34 of the box 32 of the substrate 26 to act as a clipboard 44.

(2) Plurality of Containers 28 and Plurality of Pockets 30.

The plurality of containers 28 and the plurality of pockets 30 together form a matrix 46 of columns 48 and rows 50. The columns 48 of the matrix 46 comprise a first column 52, a second column 54, a third column 56, and a fourth column 58.

The second column 54 of the columns 48 of the matrix 46 is the plurality of containers 28 with the actual pill samples 22 therein, respectively.

The first column 52 of the columns 48 of the matrix 46 is the plurality of pockets 30 whose associated information 24 are names of the actual pill samples 22 in the associated rows 50, respectively.

The third column 56 of the columns 48 of the matrix 46 is the plurality of pockets 30 whose associated information 24 are dosages of the actual pill samples 22 in the associated rows 50, respectively.

The fourth column 58 of the columns 48 of the matrix 46 is the plurality of pockets 30 whose associated information 24 are reasons taken of the actual pill samples 22 in the associated rows 50, respectively.

(3) Example of the Matrix 46.

Figure 7:
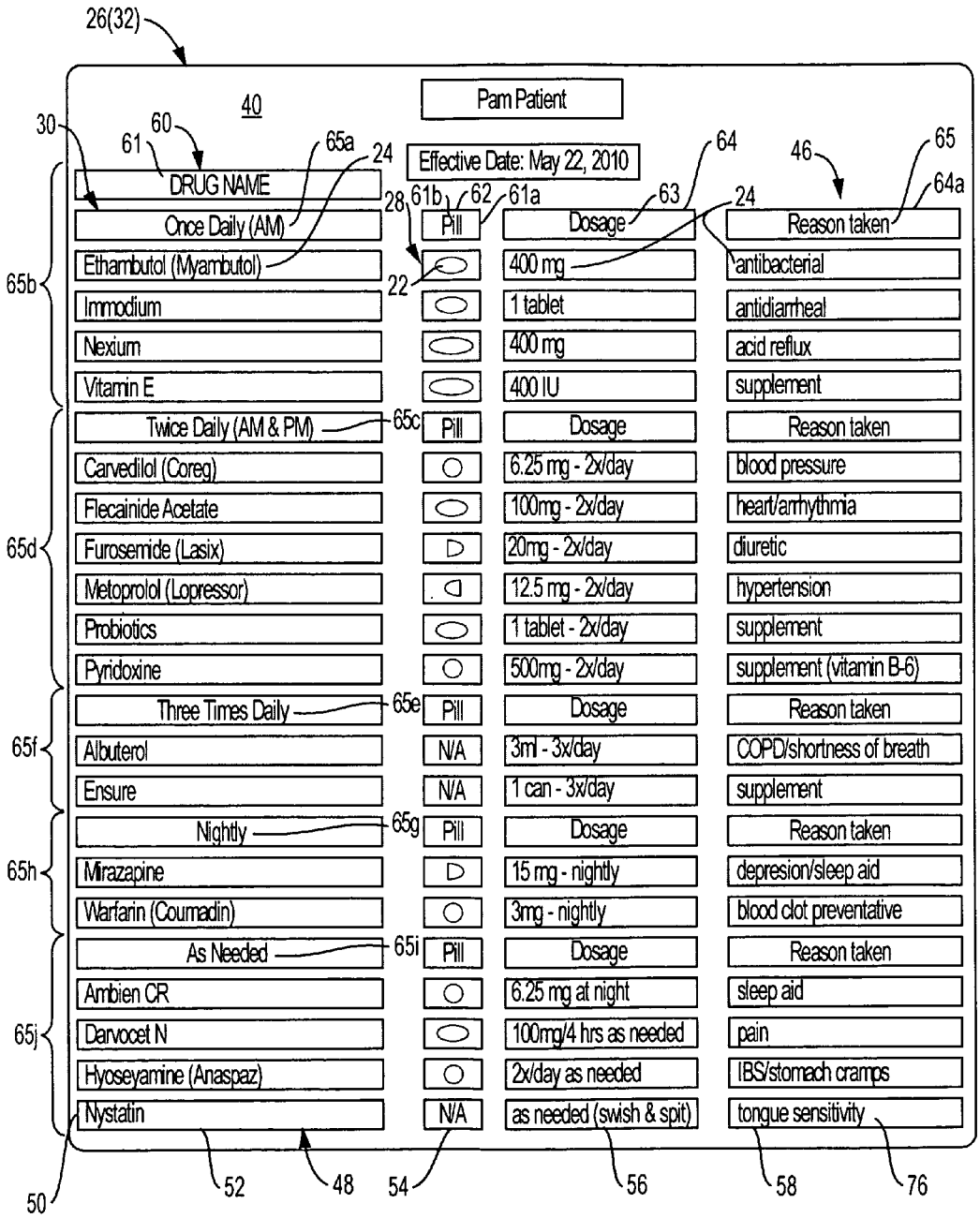
FIG. 7 is a diagrammatic front elevational view of an example of the plurality of containers with the actual sample pills therein and the plurality of pockets with the associated information thereunder of the personalizable display of the embodiments of the present invention shown in FIGS. 1 and 2.

An example of the matrix 46 can best be seen in FIG. 7.

The plurality of pockets 30 of the first column 52 of the columns 48 of the matrix 46 have a first header pocket 60 whose associated information 24 is "Drug Name" 61 preprinted on an associated slip 76.

The plurality of pockets 30 of the second column 54 of the columns 48 of the matrix 46 have a second header pocket 61*a* whose associated information 24 is "Pill" 61*b* preprinted on an associated slip 76.

The plurality of pockets 30 of the third column 56 of the columns 48 of the matrix 46 have a third header pocket 64 whose associated information 24 is "Dosage" 63 preprinted on an associated slip 76.

The plurality of pockets 30 of the fourth column 58 of the columns 48 of the matrix 46 have a fourth header pocket 64*a* whose associated information 24 is "Reason Taken" 65 preprinted on an associated slip 76.

The slips 76 of the plurality of pockets 30 are color-coded so as to group together medications taken at different times a day. For example:

- The associated information 24 of a first group of the first column 52 of the columns 48 of the matrix 46 includes "Once Daily (AM)" 65*a*, and which the slips 76 therefor are a first color 65*b;*
- The associated information 24 of a second group of the first column 52 of the columns 48 of the matrix 46 includes "Twice Daily (AM & PM)" 65*c*, and which the slips 76 therefor are a second color 65*d;*
- The associated information 24 of a third group of the first column 52 of the columns 48 of the matrix 46 includes "Three Times Daily" 65*e*, and which the slips 76 therefor are a third color 65*f;*
- The associated information 24 of a fourth group of the first column 52 of the columns 48 of the matrix 46 includes "Nightly" 65*g*, and which the slips 76 therefor are a fourth color 65*h*; and
- The associated information 24 of a fifth group of the first column 52 of the columns 48 of the matrix 46 includes "As Needed" 65*i*, and which the slips 76 therefor are a fifth color 65*j*.

C. Specific Configuration of the Plurality of Containers 28.

The plurality of containers 28 are identical to each other so for the sake of brevity, only one container 28 will be discussed.

Figure 8:
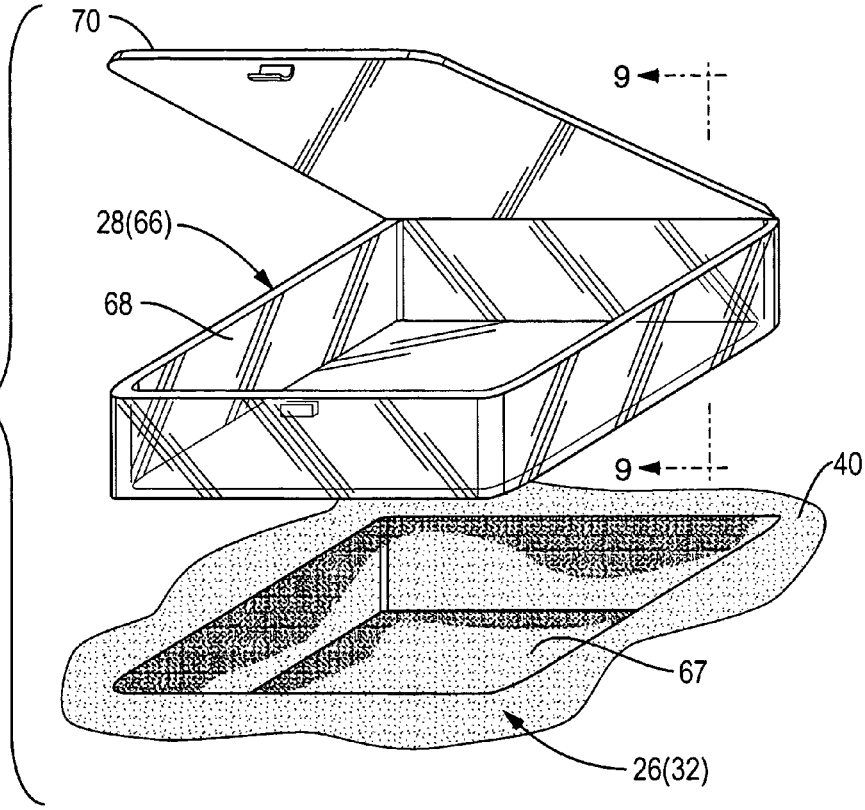
FIG. 8 is an enlarged and exploded diagrammatic perspective view of a typical pill container of the personalizable display of the embodiments of the present invention identified by ARROW 8 in FIG. 2.
Figure 9:
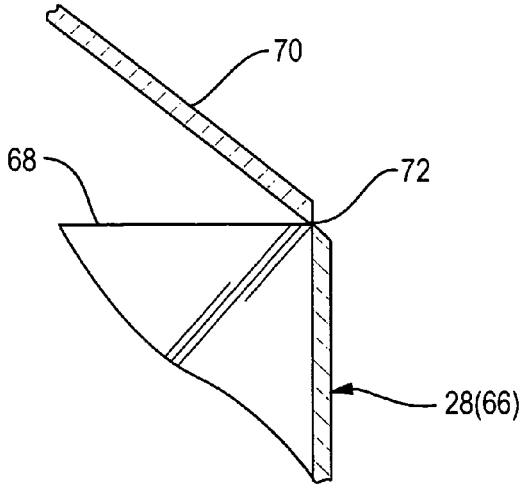
FIG. 9 is an enlarged diagrammatic cross sectional view taken along LINE 9-9 in FIG. 8 of the living hinge of a typical pill container of the personalizable display of the embodiments of the present invention.

The specific configuration of the one container 28 can best be seen in FIGS. 8 and 9, which are, respectively, an enlarged and exploded diagrammatic perspective view of a typical pill container of the personalizable display of the embodiments of the present invention identified by ARROW 8 in FIG. 2, and an enlarged diagrammatic cross sectional view taken along LINE 9-9 in FIG. 8 of the living hinge of a typical pill container of the personalizable display of the embodiments of the present invention, and as such, will be discussed with reference thereto.

The container 28 is a box 66. The box 66 of the container 28 sits visually and operatively in a void 67 in the rear wall 40 of the box 32 of the substrate 26, and has an open top 68 that is selectively closed by a lid 70 that is attached to the box 66 of the container 28 by a living hinge 72 so as to provide access to the box 66 of the container 28 for putting the actual pill sample 22 therein.

D. Specific Configuration of the Plurality of Pockets 30.

The plurality of pockets 30 are identical to each other so for the sake of brevity, only one pocket 30 will be discussed.

The specific configuration of the one pocket 30 can best be seen in FIGS. 10A and 10B, which are, respectively, an enlarged diagrammatic front elevational view of typical top loading pocket of the personalizable display of the embodiments of the present invention identified by ARROW 10A in FIG. 2, and an enlarged diagrammatic front elevational view of typical side loading pocket of the personalizable display of the embodiments of the present invention identified by ARROW 10B in FIG. 2, and as such, will be discussed with reference thereto.

The pocket 30 is a transparent and generally rectangular-shaped pocket 74 so as to allow the slip 76 having the associated information 24 thereon to slide therein and be read therethrough.

As shown in FIG. 10A, the transparent and generally rectangular-shaped pocket 74 of the pocket 30 has, preferably, an open top 78 so as to allow the slip 76 to slide into the transparent and generally rectangular-shaped pocket 74 of the pocket 30 from above, as shown by slip insertion arrow 80, while gravity and a pressure fit maintain the slip 76 in the transparent and generally rectangular-shaped pocket 74 of the pocket 30.

As shown in FIG. 10B, the transparent and generally rectangular-shaped pocket 74 of the pocket 30 has open sides 82 so as to allow the slip 76 to slide into the transparent and generally rectangular-shaped pocket 74 of the pocket 30 from either side, as shown by slip insertion arrows 84, while a pressure fit maintains the slip 76 in the transparent and generally rectangular-shaped pocket 74 of the pocket 30.

E. Specific Configuration of Multiple Personalizable Displays 20.

As shown in FIG. 11, which is a diagrammatic perspective view of the personalizable display of the embodiments of the present invention including a pair of side-by-side boxes detachably attached to each other for ready expansion to double capacity and pivotally hinged to each other so as to store like a book, when the amount of the actual pill samples 22 exceeds the space allotted for in a first personalizable display 20A, then a second personalizable display 20B is employed. The first personalizable display 20A and the second personalizable display 20B are disposed side-by-side and pivotally hinged to each other by a hinge 86 so as to store like a book and be able to open and close, as shown by arrow 88.

F. Stickers 90.

The personalizable display 20 further comprises stickers 90.

The configuration of the stickers 90 can best be seen in FIG. 2, which is, again, a reduced diagrammatic perspective view of the personalizable display of the embodiments of the present invention identified by ARROW 2 in FIG. 1, and as such, will be discussed with reference thereto.

The stickers 90 are for sticking to pill bottle caps 92, and have dosage information thereon corresponding to pills in the associated bottle. For example:

The dosage information for first stickers 90 includes "AM" corresponding to the"Once Daily (AM)" 65*a* of the associated information 24 of the first group of the first column 52 of the columns 48 of the matrix 46;

The dosage information for second stickers 90 includes "AM & PM" corresponding to the "Twice Daily (AM & PM)" 65*c* of the associated information 24 of the second group of the first column 52 of the columns 48 of the matrix 46;

The dosage information for third stickers 90 includes "3X" corresponding to the "Three Times Daily" 65*e* of the associated information 24 of the third group of the first column 52 of the columns 48 of the matrix 46;

The dosage information for fourth stickers 90 includes "Nightly" corresponding to the "Nightly" 65*g* of the associated information 24 of the fourth group of the first column 52 of the columns 48 of the matrix 46; and The dosage information for fifth stickers 90 includes "PRN" corresponding to the "As Needed" 65*i* of the associated information 24 of the fifth group of the first column 52 of the columns 48 of the matrix 46.

G. Impressions.

It will be understood that each of the elements described above or two or more together may also find a useful application in other types of constructions differing from the types described above.

While the embodiments of the present invention have been illustrated and described as embodied in a personalizable display for identifying actual pill samples and indicating associated information so as to visually correlate the actual pill samples with the associated information, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A personalizable display for identifying actual pill samples and indicating associated information so as to visually correlate the actual pill samples with the associated information, comprising:

a substrate;

b) a plurality of containers; and c) a plurality of pockets;

wherein said plurality of containers are disposed in said substrate;

wherein said plurality of containers are for visually holding the actual pill samples;

wherein said plurality of pockets are disposed on said substrate;

wherein said plurality of pockets are for visually holding the associated information; and wherein said plurality of pockets are disposed adjacent to associated containers of said plurality of containers so as to visually correlate the actual pill samples with the associated information and identify the actual pill samples;

wherein said substrate is a box;

wherein said box of said substrate;

d) has a front wall; and e) contains a storage compartment;

wherein said front wall of said box of said substrate has a clip thereon so as to allow said front wall of said box of said substrate to act as a clipboard;

wherein said plurality of containers and said plurality of pockets together form a matrix of columns and rows; and wherein said columns of said matrix comprise:

e) a first column;

f) a second column;

g) a third column; and h) a fourth column;

wherein said plurality of pockets of said first column of said columns of said matrix have a first header pocket whose associated information is the text: Drug Name.

2. The display of claim 1, wherein said front wall of said box of said substrate is hingedly attached to said box of said substrate by a hinge so as to allow access to said storage compartment in said box of said substrate.

3. The display of claim 1, wherein said box of said substrate has a rear wall;

wherein said rear wall of said box of said substrate opposes said front wall of said box of said substrate; and wherein said rear wall of said box of said substrate has said plurality of containers and said plurality of pockets operating therein/thereon, respectively.

4. The display of claim 1, wherein said second column of said columns of said matrix is said plurality of containers, with the actual pill samples therein, respectively.

5. The display of claim 1, wherein said first column of said columns of said matrix is said plurality of pockets whose associated information are names of the actual pill samples in associated rows, respectively.

6. The display of claim 1, wherein said third column of said columns of said matrix is said plurality of pockets whose associated information are dosages of the actual pill samples in associated rows, respectively.

7. The display of claim 1, wherein said fourth column of said columns of said matrix is said plurality of pockets whose associated information are reasons taken of the actual pill samples in associated rows, respectively.

8. The display of claim 1, wherein said plurality of pockets of said second column of said columns of said matrix have a second header pocket whose associated information is the text: Pill.

9. The display of claim 1, wherein said plurality of pockets of said third column of said columns of said matrix have a third header pocket whose associated information is the text: Dosage.

10. The display of claim 3, wherein each container is a box.

11. The display of claim 10, wherein said box of each container sits visually and operatively in a void in said rear wall of said box of said substrate;

wherein said box of each container has an open top;

wherein said open top of said box of each container is selectively closed by a lid; and wherein said lid of said box of each container is attached to said box of an associated container by a living hinge so as to provide access to said box of said associated container for putting the associated actual pill sample therein.

12. The display of claim 1, wherein said associated information is on a slip; and wherein each pocket is a transparent and generally rectangular-shaped pocket so as to allow said slip having said associated information thereon to slide therein and be read therethrough.

13. The display of claim 12, wherein said transparent and generally rectangular-shaped pocket of said pocket has an open top so as to allow said slip to slide into said transparent and generally rectangular-shaped pocket of said pocket from above, while gravity and a pressure fit maintain said slip in said transparent and generally rectangular-shaped pocket of said pocket.

14. The display of claim 12, wherein said transparent and generally rectangular-shaped pocket of said pocket has open sides so as to allow said slip to slide into said transparent and generally rectangular-shaped pocket of said pocket from either side, while a pressure fit maintains said slip in said transparent and generally rectangular-shaped pocket of said pocket.

15. The display of claim 1, wherein said plurality of pockets of said first column of said columns of said matrix have a first header pocket whose associated information is the text: Drug Name, which text is preprinted on an associated slip.

16. The display of claim 1, wherein said plurality of pockets of said second column of said columns of said matrix have a second header pocket whose associated information is the text: Pill, which text is preprinted on an associated slip.

17. The display of claim 1, wherein said plurality of pockets of said third column of said columns of said matrix have a third header pocket whose associated information is the text: Dosage, which text is preprinted on an associated slip.

18. The display of claim 1, wherein said plurality of pockets of said fourth column of said columns of said matrix have a fourth header pocket whose associated information is the text: Reason Taken, which text is preprinted on an associated slip.

19. The display of claim 12, wherein said slips of said plurality of pockets are color-coded so as to group together medications taken at different times a day.

20. The display of claim 1, wherein said associated information of a first group of said first column of said columns of said matrix includes the information: Once Daily AM, wherein said text of AM within said information is encompassed by parenthesis and which said slips therefor are a first color.

21. The display of claim 20, wherein said associated information of a second group of said first column of said columns of said matrix includes the information: Twice Daily AM & PM, wherein said text of AM & PM within said information is encompassed by parenthesis and which said slips therefor are a second color.

22. The display of claim 21, wherein said associated information of a third group of said first column of said columns of said matrix includes the information: Three Times Daily and which said slips therefor are a third color.

23. The display of claim 22, wherein said associated information of a fourth group of said first column of said columns of said matrix includes the information: Nightly and which said slips therefor are a fourth color.

24. The display of claim 23, wherein said associated information of a fifth group of said first column of said columns of said matrix includes the information: As Needed and which said slips therefore are a fifth color.

25. The display of claim 24, further comprising stickers.

26. The display of claim 25, wherein said stickers are for sticking to pill bottles and have dosage information thereon corresponding to pills in the associated bottle.

27. The display of claim 26, wherein said dosage information for first stickers includes the text AM corresponding to said Once Daily AM of said associated information of said first group of said first column of said columns of said matrix; and wherein said text of AM of said Once Daily AM is encompassed by parenthesis.

28. The display of claim 26, wherein said dosage information for second sticker includes the text AM & PM corresponding to said Twice Daily AM & PM of said associated information of said second group of said first column of said columns of said matrix; and wherein said text of AM of said Once Daily AM is encompassed by parenthesis.

29. The display of claim 26, wherein said dosage information for third stickers includes the text 3X corresponding to said Three Times Daily of said associated information of said third group of said first column of said columns of said matrix.

30. The display of claim 26, wherein said dosage information for fourth stickers includes the text Nightly corresponding to said Nightly of said associated information of said fourth group of said first column of said columns of said matrix.

31. The display of claim 26, wherein said dosage information for fifth stickers includes the text PRN corresponding to said As Needed of said associated information of said fifth group of said first column of said columns of said matrix.

32. The display of claim 1, wherein said plurality of pockets of said fourth column of said columns of said matrix have a fourth header pocket whose associated information is the text Reason Taken.

* * * * *